US010156057B2

(12) United States Patent
Buckner

(10) Patent No.: US 10,156,057 B2
(45) Date of Patent: Dec. 18, 2018

(54) ROTATABLE HYDRO EXCAVATION SUCTION WAND

(71) Applicant: Don M. Buckner, Okahumpka, FL (US)

(72) Inventor: Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 124 days.

(21) Appl. No.: 15/284,018

(22) Filed: Oct. 3, 2016

(65) Prior Publication Data

US 2018/0094400 A1 Apr. 5, 2018

(51) Int. Cl.
*E02F 3/92* (2006.01)

(52) U.S. Cl.
CPC ..... *E02F 3/9293* (2013.01); *E02F 3/9262* (2013.01)

(58) Field of Classification Search
CPC ..... E02F 3/88; E02F 3/8816; E02F 3/8825; E02F 3/8891; E02F 3/9293
USPC ..... 37/317, 323, 335, 336
See application file for complete search history.

(56) References Cited

U.S. PATENT DOCUMENTS 220,180 A * 9/1879 Shaw ..... E02F 3/907 37/312
909,543 A 1/1909 Carlesimo
1,530,654 A * 3/1925 Daley ..... B65G 53/42 144/60
1,686,321 A * 10/1928 Groh ..... E02F 3/905 37/330
3,020,107 A * 2/1962 Habermaas ..... E02F 9/121 37/189
3,657,829 A * 4/1972 Lovelace ..... E02F 3/905 37/323
3,777,376 A * 12/1973 Turner ..... E02F 3/9231 37/309
4,058,914 A * 11/1977 Kiss ..... E02F 3/92 37/329
4,070,135 A * 1/1978 Eller ..... F04D 29/605 37/317
4,318,233 A 3/1982 Romain
4,423,559 A * 1/1984 Malin ..... F16L 27/04 15/410
4,479,741 A * 10/1984 Berti ..... E02F 3/925 405/163

(Continued)

FOREIGN PATENT DOCUMENTS

DE 1930716 A1 * 4/1971 ..... E02F 3/9231
WO WO-8808470 A1 * 11/1988 ..... E02F 3/88

*Primary Examiner* — Matthew D. Troutman
(74) *Attorney, Agent, or Firm* — Matthew G. McKinney, Esq.; Allen, Dyer, Doppelt + Gilchrist, PA

(57) ABSTRACT

A rotatable hydro excavation suction wand includes an upper section having an upper end configured to be connected to a suction hose, an angled lower section secured to a lower end of the upper portion and the angled lower section having an open end, and a rotary manifold connecting the upper section to the angled lower section and configured to rotate the angled lower section as the upper section remains fixed. The suction wand also includes a pressurized line coupled to the rotary manifold, where the angled lower section is adapted to rotate causing the open end to track in a circular motion covering an area larger than a diameter of the suction wand.

15 Claims, 3 Drawing Sheets

(56) References Cited

U.S. PATENT DOCUMENTS

| | | | | |
|---|---|---|---|---|
| 5,129,167 | A * | 7/1992 | Nakahara | E02F 3/88 37/318 |
| 5,212,891 | A | 5/1993 | Schuermann et al. | |
| 6,691,436 | B2 | 2/2004 | Chizek, Sr. | |
| 7,743,537 | B2 | 6/2010 | Maybury, Jr. | |
| 2005/0108848 | A1 | 5/2005 | Buckner | |

* cited by examiner

FIG. 5
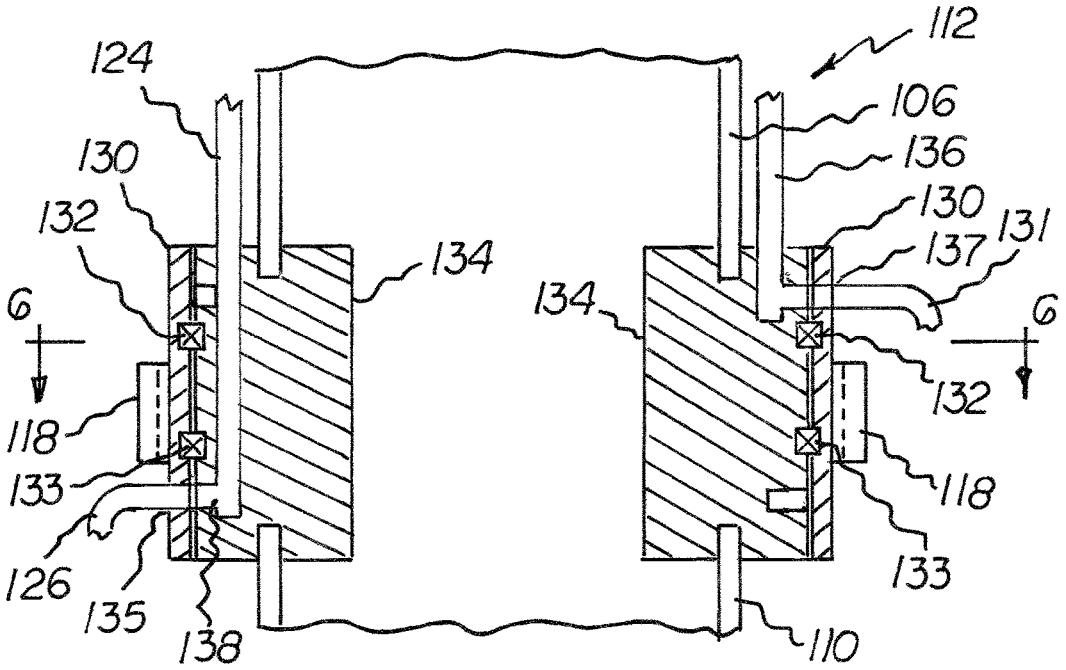
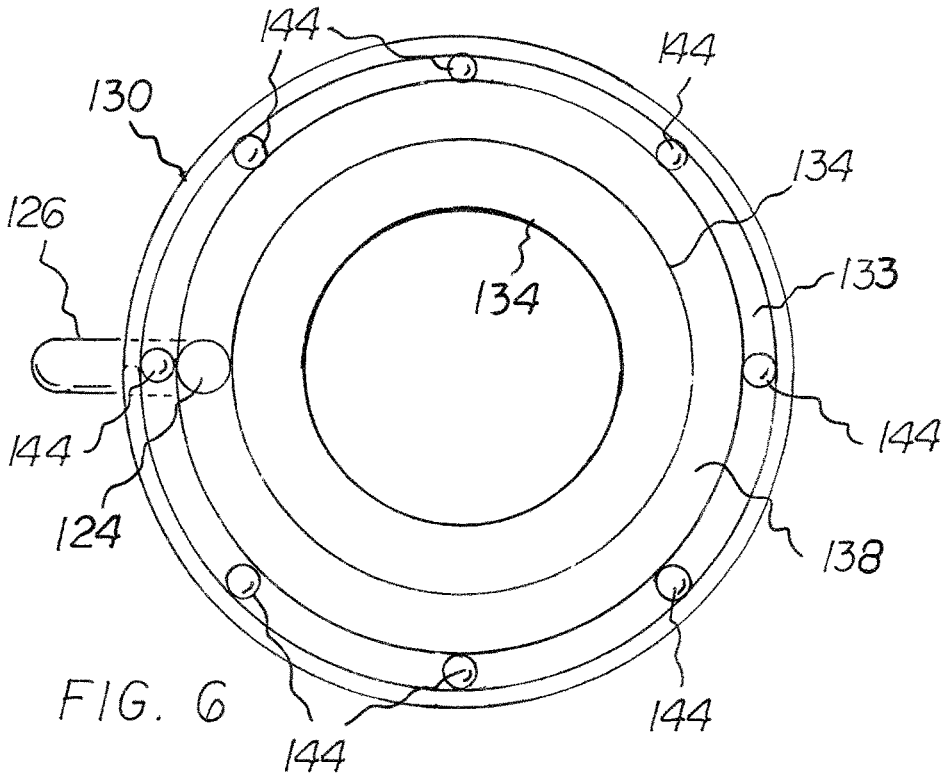
FIG. 6

ROTATABLE HYDRO EXCAVATION SUCTION WAND

TECHNICAL FIELD

The present invention relates to the field of hydro excavation, and, more particularly, to a rotatable hydro excavation suction wand.

BACKGROUND

Industrial vacuum equipment has dozens of wet and dry uses such as locating underground utilities (potholing), hydro excavation, air excavation and vacuum excavation. In addition, the equipment can be used for directional drilling slurry removal, industrial clean-up, waste clean-up, lateral and storm drain clean-out, oil spill clean-up and other natural disaster clean-up applications, signs and headstone setting, for example. The vacuum systems may be mounted to a truck or trailer and are typically powered by gas or diesel engines. A shortcoming of the prior art is the inefficiency and difficulty to excavate using a vacuum hose in hard subsurface conditions. Accordingly, what is needed is a hydro excavation device that is efficient in all subsurface conditions.

SUMMARY

In view of the foregoing background, it is therefore an object of the present invention to provide a rotatable hydro excavation suction wand. The suction wand includes an upper section having an upper end configured to be connected to a suction hose, an angled lower section secured to a lower end of the upper portion and the angled lower section having an open end, and a rotary manifold connecting the upper section to the angled lower section and configured to rotate the angled lower section as the upper section remains fixed. The suction wand also includes a pressurized line coupled to the rotary manifold, where the angled lower section is adapted to rotate manually or automatically causing the open end to track in a circular motion covering an area larger than a diameter of the suction wand.

In another embodiment, a method of hydro excavation is disclosed. The method includes grasping a suction wand having an upper section and a lower angled section, placing downward force on the suction wand to excavate material from a hole using suction, and rotating the lower angled section using a rotary manifold connecting the upper section to the angled lower section, where the rotary manifold configured to rotate the angled lower section as the upper section remains fixed.

BRIEF DESCRIPTION OF THE DRAWINGS

FIG. 5 is a cross sectional view of the rotary manifold taken in the direction of line 5-5 of FIG. 4; and FIG. 6 is a cross sectional view of the rotatory manifold taken in the direction of 6-6 of FIG. 5.

DETAILED DESCRIPTION

Figure 1:
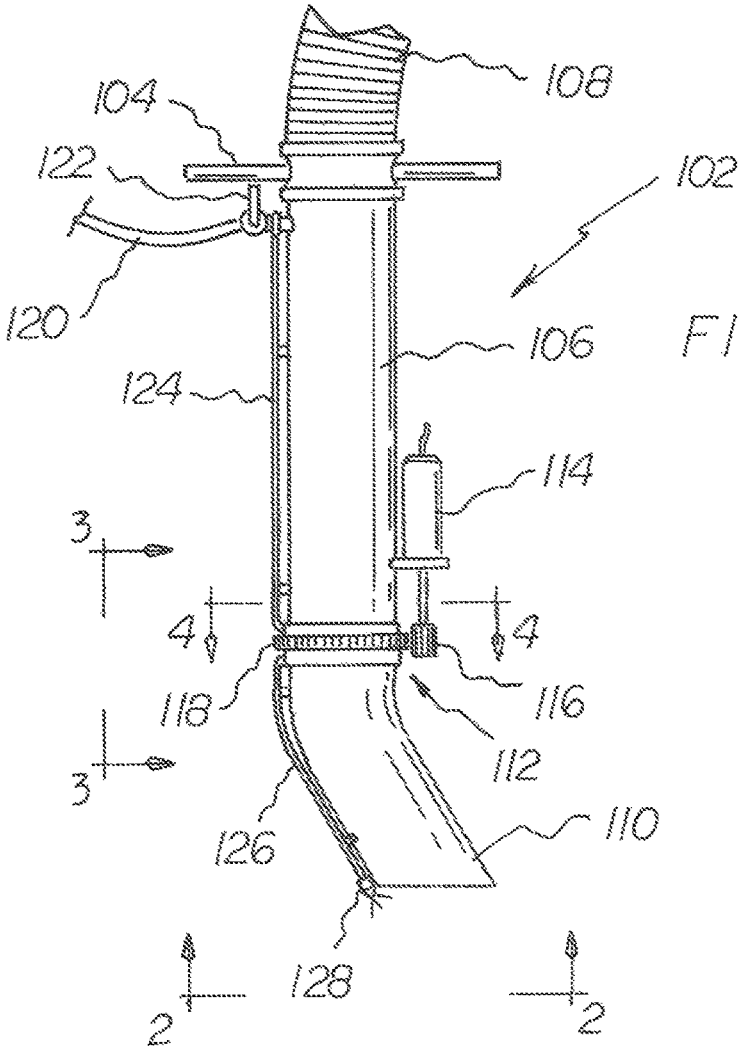
FIG. 1 is an elevation view of a particular embodiment of a rotatable hydro excavation suction wand.
Figure 2:
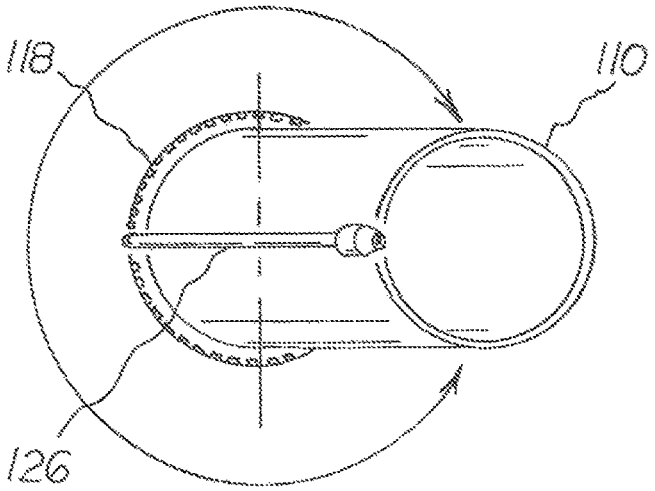
FIG. 2 is a perspective view of an open end of the suction wand taken in the direction of line 1-1 of FIG. 1.
Figure 3:
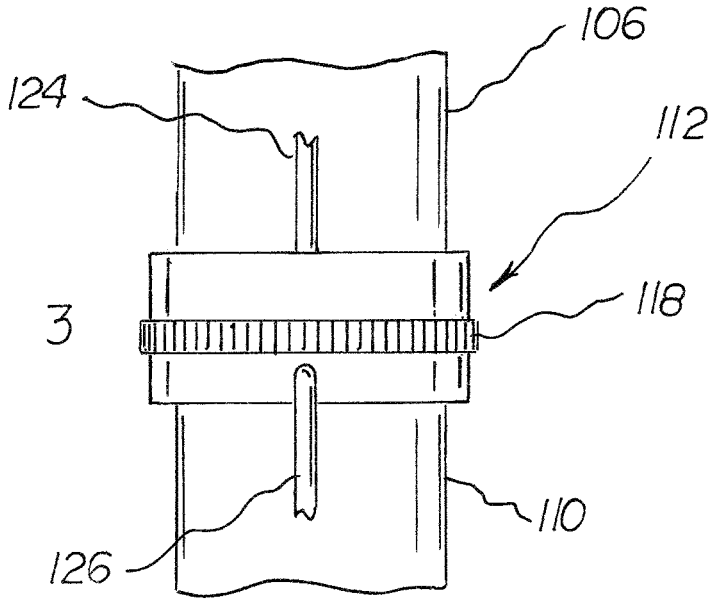
FIG. 3 is a detail elevational view of a rotary manifold of the suction wand of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Referring to FIGS. 1-4, a particular illustrative embodiment of a rotatable hydro excavation suction wand 102 is disclosed. The suction wand 102 includes an upper section 106 having an upper end configured to be coupled to a suction hose 108. A handle 104 may also be secured proximate the upper end of the upper section 106 of the suction wand 102. The suction wand 102 also includes an angled lower section 110 secured to a lower end of the upper portion and the angled lower section 110 having an open end.

A rotary manifold 112 joins the upper section 106 to the angled lower section 110 and is configured to rotate the angled lower section 110 as the upper section 106 remains fixed. The rotary manifold 112 may include a motor 114 to rotate the angled lower section 110.

A pressurized line 120 may be in fluid communication with a valve 122 secured to the suction wand 102. The pressurized line 120 may provide pressurized air and/or water to a nozzle 128 located proximate the open end of the angled lower section 110 via upper and lower pressurized lines 124, 126. The upper pressurized line 124 is in fluid communication with the valve 122 and the rotary coupling 112. The pressurized fluid passes through the rotary coupling 112 to the lower pressurized line 126, which is in fluid communication with the nozzle 128.

The rotary coupling may rotate in a manner of different ways. A particular embodiment provides that a ring gear 118 is secured to a periphery of the rotary manifold 112. The ring gear 118 includes a series of teeth that are adapted to engage teeth of a driving gear 116. The driving gear 116 is configured to drive the ring gear 118, which in turn causes the angled lower section 110 to rotate. The driving gear 116 may be driven by motor 116 secured to the upper section 106 of the suction wand 102.

Figure 4:
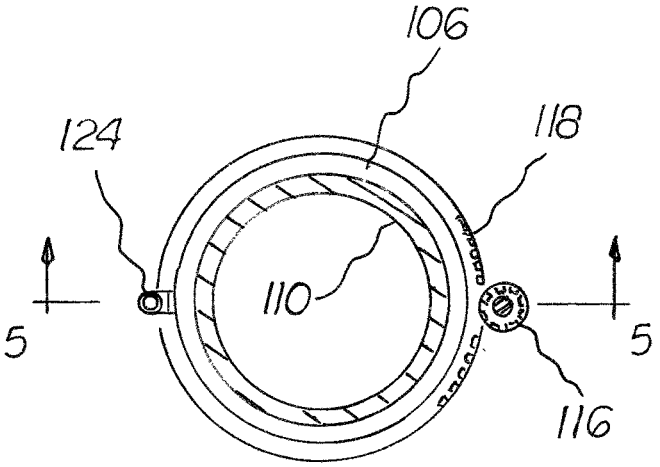
FIG. 4 is a cross sectional view of the suction wand taken in the direction of line 4-4 of FIG. 1.

Referring now to FIGS. 5 and 6, a cross sectional view taken in the direction of line 5-5 of FIG. 4, shows the rotary manifold 112 that is used to transfer the pressurized fluid entering from the upper pressurized line 124 to the lower pressurized fluid line 126. Raceways 132, 133 are between the inner portion 134 and the outer portion 130 of the rotary manifold 112. The inner portion 134 is configured to remain stationary as the outer portion 130 is configured to rotate with the angled lower portion 110 using the bearings 144 within the raceways 132, 133. The inner portion 134, which may be annular shaped, receives the upper pressurized fluid line 124 which passes through the inner portion 134 to a passageway 138 that is in fluid communication with a port 135 for the lower pressurized fluid line 126. The ring gear described above is secured to the lower annular casing 136.

A second upper pressurized line 136 may be also be used to supply air, steam or other type of fluid. The second upper pressurized line 136 may similarly pass through the inner portion 134 to a port 137 for a second lower pressurized line 131. Any number of pressurized lines may be used.

Referring now to FIG. 6, the raceways 132, 133 include bearings 144 that allow the outer and inner portions 130, 134 to rotate relative to each other as described above. Once the fluid passageway 138 is being filled with pressurized fluid, the port 135 for the lower pressurized fluid line 126 provides an outlet for the pressurized fluid from the fluid passageway 138. The second upper pressurized line 136 operates similarly to pass fluid through the rotary manifold 112 to the second lower pressurized line 131.

In operation, a user may grasp the handle 104 of the suction wand 102, where the suction hose 108 is in communication with a pump that provides suction to remove soil, water, and other materials that are being excavated from a site. A valve 122 may be used to control the flow of pressurized fluid to the nozzle 128. The lower section 110 is preferably a rigid material, but could also be flexible. As described above, the rotary manifold may be used to secure the upper section 106 to the lower section 110. The motor 114 may be secured to the upper section 106 using a bearing or bracket. When the lower section 110 is rotated, it causes the open end of the lower section 110 to track in an extended circular motion covering an area larger than a diameter of the upper section 106 or the lower section 110. The motor 114 stops, starts and rotates the lower section 110 at a desired speed controlled by the operator. The angle or elbow of the lower section 110 may vary depending on the application. The open end may be tapered to accommodate the circular motion of the open end and to allow the open end to remain relatively flush to the surface being excavated.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A rotatable hydro excavation suction wand comprising:

an upper section having an upper end configured to be coupled to a suction hose;

an angled lower section secured to a lower end of the upper portion and the angled lower section having an open end;

a rotary manifold joining the upper section to the angled lower section and configured to rotate the angled lower section as the upper section remains fixed; and a pressurized line coupled to the rotary manifold;

wherein the rotary manifold comprises a fluid passageway for receiving fluid from the pressurized line.

2. The rotatable hydro excavation suction wand of claim 1, wherein the rotary manifold comprises a motor to rotate the angled lower section.

3. The rotatable hydro excavation suction wand of claim 1, wherein the angled lower section is adapted to rotate manually or automatically causing the open end to track in a circular motion covering an area larger than a diameter of the suction wand.

4. The rotatable hydro excavation suction wand of claim 1, wherein the rotary manifold comprises annular inner and outer portions to house the fluid passageway therein.

5. The rotatable hydro excavation suction wand of claim 4, wherein the annular inner and outer portions comprise a raceway having bearings therebetween.

6. The rotatable hydro excavation suction wand of claim 5, wherein the annular outer portion comprises a ring gear about its periphery configured to cooperate with the motor to rotate the lower section.

7. The rotatable hydro excavation suction wand of claim 1, wherein the pressurized line having a nozzle proximate the open end of the lower angled section.

8. A rotatable hydro excavation suction wand comprising:

an upper section having an upper end configured to be connected to a suction hose;

an angled lower section secured to a lower end of the upper portion and the angled lower section having an open end;

a rotary manifold connecting the upper section to the angled lower section and configured to rotate the angled lower section as the upper section remains fixed; and a pressurized line coupled to the rotary manifold;

wherein the rotary manifold comprises a fluid passageway for receiving fluid from the pressurized line;

wherein the angled lower section is adapted to rotate causing the open end to track in a circular motion covering an area larger than a diameter of the suction wand.

9. The rotatable hydro excavation suction wand of claim 8, wherein the rotary manifold comprises a motor to rotate the angled lower section.

10. The rotatable hydro excavation suction wand of claim 9, wherein the rotary manifold comprises annular inner and outer portions to house the fluid passageway therein.

11. The rotatable hydro excavation suction wand of claim 10, wherein the annular inner and outer portions comprise a raceway therebetween having bearings.

12. The rotatable hydro excavation suction wand of claim 11, wherein the annular outer portion comprises a ring gear about its periphery configured to cooperate with the motor to rotate the lower section.

13. The rotatable hydro excavation suction wand of claim 8, wherein the pressurized line having a nozzle proximate the open end of the lower angled section.

14. A method of hydro excavation comprising:

grasping a suction wand having an upper section and a lower angled section;

placing downward force on the suction wand to excavate material from a hole using suction;

rotating the lower angled section using a rotary manifold connecting the upper section to the angled lower section, the rotary manifold configured to rotate the angled lower section as the upper section remains fixed; and directing pressurized fluid adjacent to an open end of the angled lower section of the suction wand to loosen material;

wherein the pressurized fluid passes through annular inner and outer portions housing a fluid passageway of the rotary manifold before reaching a nozzle positioned at the open end of the angled lower section.

15. The method of claim 14, further comprising rotating the angled lower portion of the suction wand in a circular motion to cover an area larger than a diameter of the suction wand.

* * * * *